US006352182B1

(12) United States Patent
Gueret

(10) Patent No.: US 6,352,182 B1
(45) Date of Patent: Mar. 5, 2002

(54) DISPENSER AND DISPENSING METHOD FOR A MULTIPHASE COMPOSITION

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/451,857

(22) Filed: Dec. 1, 1999

(30) Foreign Application Priority Data

Dec. 1, 1998 (FR) ..... 98 15142

(51) Int. Cl.[7] ..... B65D 88/54
(52) U.S. Cl. ..... 222/321.9; 222/136
(58) Field of Search ..... 222/131, 183, 222/481.5, 321.9, 386, 95, 105, 136, 145.1, 385, 207, 494

(56) References Cited

U.S. PATENT DOCUMENTS 3,785,537 A 1/1974 Appleby et al.
4,062,475 A 12/1977 Harris et al.
4,854,343 A 8/1989 Rillett
5,069,368 A * 12/1991 Godard et al. ..... 222/321.9
5,492,252 A * 2/1996 Gueret ..... 222/207
5,617,976 A * 4/1997 Gueret ..... 222/494
6,070,763 A * 6/2000 Gueret ..... 222/95

FOREIGN PATENT DOCUMENTS

EP 733559 A1 * 9/1996
EP 747292 A1 * 12/1996
FR 2 660 212 10/1991

* cited by examiner

*Primary Examiner*—Philippe Derakshani
(74) *Attorney, Agent, or Firm*—Finnegan, Henderson, Farabow, Garrett & Dunner, LLP

(57) ABSTRACT

The present application relates to a dispenser comprising a container having a variable volume interior on which an airless pump flow is fitted. A composition is arranged inside the container and formed from at least two phases which are mutually immiscible and have differing densities. The difference in densities allows the phases to separate within the container. The dispenser is configured to selectively dispense either one of the phases of the composition individually or a mixture of at least two of the phases at the same time. The invention also relates to the use of a dispenser of this type for the dispensing of a composition in a variable ratio of concentrations of the phases constituting the composition.

55 Claims, 2 Drawing Sheets

DISPENSER AND DISPENSING METHOD FOR A MULTIPHASE COMPOSITION

FIELD OF THE INVENTION

The present invention relates to a dispenser assembly for the dispensing of a composition formed from at least two phases, in a variable ratio of concentration of the phases. In particular, the invention includes dispensing of compositions formed from at least two phases which are mutually immiscible and of differing densities. The assembly according to an embodiment of the invention may be used in numerous applications. For example, the inventive assembly may be used in cosmetic applications to dispense perfumes, haircare products, skincare products, and other similar products. It also may be used for dispensing pharmaceutical, dermatological, and food products, and in other similar dispensing applications.

BACKGROUND

Dispensers fitted with an "airless pump" are commonly used in fields such as cosmetics. As used herein, the term "airless pump" refers to a pump that provides pumping of a substance from a container in essentially a single direction without permitting reverse (intake) flow of air via the pump. That is, as product is pumped from the container, the pumped product is not replaced with a corresponding volume of air through the pump. In addition to preventing reverse intake flow of "air" via the pump, an "airless pump" typically does not allow intake of any other substances to replace the volume of product pumped out of the container. For example, an "airless pump" could include a one-way valve, such as a check valve.

Cosmetic dispensers using "airless pumps" dispense products in the form of a single, generally liquid, phase. For example, body milks, moisturizing products or sunscreen products all are typically dispensed using these dispensers. Dispensers of this type are particularly advantageous in that they substantially isolate the product from the air or other surrounding environment.

Compositions with two or more phases, for example, an aqueous phase and an oily phase, also are known in the field of cosmetics. Examples of such compositions include mouthwashes, care lotions, sun lotions, skin cleansers and make-up removers, and other similar products. In these products, compositions are in the form of separate phases, either for aesthetic reasons (for example, two different colours), or as a result of the incompatibility of the compounds in each of the phases. These compositions generally are applied as a mixture or temporary mixture of the phases which form the composition, either by dispensers with a pump operating with air intake, or by bottles without a dispensing pump and generally including walls which are flexible so as to expel the product upon the application of pressure to the wall exterior.

In the field of cosmetics, behavioral studies have demonstrated that a large number of consumers use, or desire to use, perfumes of different strengths or of different notes. For example, consumers often prefer to use a somewhat lighter perfume in the morning and/or at the office and a heavier perfume in the evening. Consumption habits of this type inevitably lead to the multiplication of bottles, i.e., one for each different perfume. However, transporting numerous bottles, particularly in a handbag, may prove difficult. Moreover, only a limited number of different products may be carried.

Still in the field of perfumes, the application of perfume or cologne, generally in aqueous-alcoholic phase, often may be harsh on the skin. Under these conditions, it would be desirable to follow this application with an application of a product with soothing properties, such as Allanson or oat extract. This too requires the user to carry at least two different bottles at a time. Moreover, this multiplies the application operations and therefore increases application time.

Aside from perfumes, for a large number of cosmetic products, a user may desire to combine application of one product with the application of a product having complementary or different properties. For example, certain haircare or skin-treatment products may be used in combination with color pigments for the skin or the hair, respectively. The color pigments may vary as a function of the desired hair or make-up color.

These problems of combined or separate application of two complementary or different products also arise in fields other than cosmetics, such as the pharmaceutical, dermatology, and food industries.

SUMMARY

Thus, one of the objects of this invention is to produce a unitary assembly for the combined or separate application of two or more products with complementary or different actions.

It is a further object of the invention to produce a unitary assembly for the application of the principal phase of a composition, optionally combined with a secondary phase of the composition, so as to modify the properties of the principal phase or to confer new properties on it. In addition, the concentration of the secondary phase in the composition dispensed may be chosen as desired.

Yet a further objective of the invention is to allow the production of an assembly for the dispensing of a composition in a variable ratio of concentrations of the phases constituting the composition.

It should be understood that the invention could still be practiced without performing one or more of the preferred objects and/or advantages set forth above. Still other objects of the invention will become apparent after reading the following description of the invention.

To achieve these and other advantages, and in accordance with the purposes of the invention, an embodiment of the invention includes a dispense, comprising a container having a variable volume interior. An airless pump is in flow communication with the interior and a composition is arranged inside the container. The composition is formed from at least two phases which are substantially immiscible and have differing densities. In a preferred embodiment, the container interior volume decreases in an amount corresponding to the amount of composition pumped from the container.

As used herein, the term "container having an interior with variable volume" refers to a container whose interior volume reduces in conjunction with the dispensing of the product from the container. In a preferred embodiment, the interior volume decreases in an amount proportional to the amount by volume of product dispensed from the container. The reduction in the volume of the container results from the reduced pressure which occurs with each dispensing of the product from inside the container. The dispensed product volume is not replaced by a corresponding volume of air or other substance, due to the absence of intake of air. Indeed, the pump prevents intake of air or other substance into the container, which otherwise would offset the reduction in product volume inside the container interior. The pump may optionally be of the precompression type so as to promote the mixing of the phases of the composition.

The composition according to the invention comprises at least two phases that are not permanently and completely miscible. For example, the two phases may include two substantially immiscible oily phases of different densities, an oily phase and an aqueous phase or an oily phase and an aqueous-alcoholic phase, or other similar combinations of phases. As a result of the difference in density between the two immiscible phases, the heavier phase should normally be deposited (sedimented) in the bottom of the container while the lighter phase should normally float on top of the heavier phase. The rate of separation of the phases varies as a function of the difference in density between the two phases. Agitating the contents of the container preferably forms a substantially homogeneous "mixture" of the two phases in the form of a dispersion, suspension or emulsion. By allowing the composition to be free of agitation, the phases "demix", or separate, through the affect of their density differences. By selectively arranging the container, it is possible to dispense either one of the individual phases at a time, or a mixture of the two phases at the same time. The present invention preferably allows a user to control the respective concentrations of each of the phases of the dispensed composition and thereby enables a user to dispense a multitude of different compositions using a single device.

For example, it is possible to dispense a perfume or cologne whose strength and scent may be chosen as desired. The user thus has available, inside a single dispenser, a perfume of lighter scent and perfume of stronger scent, for example. Furthermore, the user may change the strength of the perfume scent in a subtle and continuing manner, from the lighter to the stronger, for example, by controlling the ratio of concentrations of the mixture of the two perfumes. Such ratio could be controlled by the length of time and degree of agitation applied to the dispenser.

In a manner similar to controlling the strength of perfume scent to be applied, it also is possible to dispense a color or make-up composition whose shades and nuances may be chosen as desired by using the inventive dispenser.

According to a further advantageous aspect of the invention, it is possible to have a first phase product (for example, perfume, cologne, moisturizing composition or the like) forming the principal phase of the composition, that is the phase applied principally or routinely, and a secondary phase product (for example, products containing sun filters, softeners, cicatrizing agents, soothing agents, essential oils) within the interior of the container. Thus, the user may use each phase either individually, or in combination, so as to modify the characteristics of or add properties to the principal phase. The concentration of the secondary phase that is dispensed preferably depends to a large extent on the degree of agitation of the dispenser prior to dispensing.

According to yet another aspect of the invention, the composition may comprise two liquid phases. For example, these may include an alcoholic or aqueous-alcoholic first phase (for example, a perfume) and a second oily phase (for example, a softening or soothing care product). The liquid may also be in the form of a gel or of an emulsion (for example, a hydrocarbon phase). As discussed in detail below, the composition used in the dispensing assembly according to the invention also may comprise a liquid phase and a particulate, preferably a solid particulate, phase. The particles may be heavier or lighter than the liquid phase.

In the case of a composition formed from a first liquid phase and from a second liquid phase, arranging the dispenser in a first position (for example, an upright position), causes the phase in flow communication with the pump to be dispensed. The lighter phase will be dispensed when the pump is provided without a dip tube (i.e., a tube providing flow communication between the pump and the bottom region of the container interior) and the heavier phase will be dispensed when the pump includes a dip tube. By inverting the container from the first position to a second position (for example, an upside-down position), the heavier phase will be dispensed when the pump is provided without a dip tube and the lighter phase will be dispensed when the pump includes a dip tube. By agitating the contents of the container so as to form a substantially homogeneous mixture or suspension of the two phases, a mixture formed partly from each of the phases will be dispensed. The respective concentrations of each of the phases preferably depend to a large extent on the degree of agitation and on the dispensing position, for example, upright or upside-down.

In the case of a composition having a particulate phase in a liquid phase, it is possible to dispense the liquid phase either alone or in combination with the particulate phase. The concentration of particles of the composition dispensed depends in part on the degree of agitation of the container.

According to a preferred embodiment of the invention, the dispenser container may include at least one deformable portion. For example, the container may be formed from a flexible pouch. A pouch of this type may be formed from one or more layers of thermoplastic materials, such as polyethylene, polypropylenes, PET and/or metallic materials, such as aluminium. Preferably, the thickness of the walls is sufficiently small so as to allow them to come into contact and collapse upon themselves as the product is pumped from the container without replacement by a corresponding volume of air during dispensing. The cross section of the container may have any shape, such as, for example, square, oval, circular, elliptical, octagonal, and other suitable shapes.

The embodiment including a flexible walled pouch is particularly advantageous in that it offers increased operational flexibility. Moreover, the pouch with flexible walls makes it possible to use highly liquid phases, which may be more difficult to achieve with other devices.

Preferably, the pouch with flexible walls is arranged inside a rigid enclosure or housing. This rigid enclosure ensures that the container does not collapse or fall over, particularly when placed in an upright position, practically empty. Preferably, an air-intake orifice is provided in the housing holding the pouch. A particularly suitable location for such an orifice is in the bottom of the enclosure. This allows the intake of air into the area located between the rigid housing and the flexible pouch as the latter shrinks in volume after each dispensing operation.

A mechanism to prevent the blocking of an inlet passage of the pump may be provided when the walls of the pouch collapse on themselves in conjunction with the emptying of the container. In the case of a pump without a dip tube, it is preferable to provide either a corrugated grid arranged inside the container or protuberances made on the walls of the flexible container. Such corrugations or protuberances define channels that allow the product to be conveyed towards the pump when the pouch walls are in a collapsed state as a result of dispensing. Other mechanisms for defining a product flow path also may be used and are considered within the scope of this invention.

Alternatively, the container includes one of a flexible tube, a bottle with walls forming a bellows, a blown or coextruded bottle with thin walls, a container with a membrane, particularly an elastic membrane, or a bottle including a follower piston arranged inside.

In using a container equipped with a follower piston to dispense one or more liquid phases, it is preferable to provide a seal to prevent leakage of liquid around the piston head. To accomplish such sealing, the piston peripheral surface is preferably disposed against the inner surface of the container. However, as the piston's peripheral surface gets closer to the container inner surface operating flexibility may decrease. Moreover, when agitating the container to dispense a mixture of the phases contained in the container, one should take care to avoid moving the piston back into the body of the container, possibly disrupting dispensing.

The pump may be fitted directly onto the container or onto an intermediate fitting piece by crimping, screwing, force-fitting, or other suitable like fitting methods.

The pump also may be supplied with product from the bottom portion of the container via a dip tube, or other suitable delivery mechanism. The tube free end descends from the pump to approximately the bottom of the container. Thus, in the case of a composition with two liquid phases, the pump is preferably supplied with the heavier phase product when the dispenser is in the upright position. When the dispenser is in the upside-down position, the pump is preferably supplied with the lighter phase product via the dip tube. The pump may also be in direct flow communication, i.e., without a dip tube. In the absence of a dip tube, the pump preferably includes a pushbutton coupled to the pump. Such a pump also may include a diffusion mechanism, such as a nozzle. Other similar suitable diffusion mechanisms also may be used and include, for example, a grid, a frit, and an applicator endpiece.

According to yet another embodiment of the invention, the composition to be dispensed includes a liquid phase and a particulate phase, in particular a solid particulate phase, with the particulate phase having a density different than that of the liquid phase. The particles may be either heavier or lighter than the liquid phase. Particles of this type may be in the form of a powder, microcapsules or nanocapsules, pigments, fillers, pearlizers or talc, or other similar particles.

An example of such a liquid/solid particulate composition includes a liquid perfume phase incorporating microcapsules containing the liquid perfume phase or another perfume in the form of essential oils. The walls of microcapsules of this type may be formed from phenolic compounds, alginate, gelatin, cyanoacrylate, or other similar suitable materials.

An example of such a liquid/solid particulate composition includes 5 g of microcapsules of the above-described type placed in a 50 ml container. The container is filled up with the liquid phase, which may be in the form of a perfume. The microcapsule particles, which are heavier than the liquid, settle in the bottom of the container. When the dispenser supplied with a pump having no dip tube is held upright, preferably only the perfume is sprayed or dispensed. By agitating the container, the microcapsules tend to be suspended in the liquid phase. The microcapsule concentration at a given location in the container generally depends on the degree of agitation of the container. The product contained in the microcapsules is released, either by "crushing" action during their passage through the pump, or by light massaging after deposition on the skin.

Preferably, the particulate phase represents approximately 0.5% to approximately 30% by volume of the total volume of the composition and, more preferably, approximately 1% to approximately 10% of the total volume of the composition.

According to yet another embodiment, the composition includes two substantially immiscible liquid phases of different densities. By way of example, this can include an aqueous or aqueous-alcoholic phase and an oily phase.

An agitation mechanism, such as a ball provided within the container interior, may be provided so as to allow the contents of the container to be mixed more effectively during agitation of the container. This agitation mechanism may be especially advantageous in the case of two phases which are relatively difficult to mix.

Yet another aspect of the invention relates to the use of a container of variable volume interior provided with a pump that preferably permits flow in only one direction to dispense a composition in a variable ratio of concentrations of n phases, where $n \geqq 2$ and at least one of the phases is liquid. The phases additionally are substantially mutually immiscible and have differing densities.

The ratio of the respective concentrations of each of the phases preferably varies throughout a relatively wide range. At one end of the range, the composition dispensed may be formed of 100% of the light phase. At the other end of the range, the composition for dispensing may be formed of 100% of the heavy phase. Preferably there are numerous phase concentrations between the two extremes and they are chosen by the user as desired, preferably by altering the degree and period of agitation prior to application.

In the case of a three-phase composition, including, for instance, two liquid phases, it is possible to selectively dispense a first, lower density phase individually or a second higher density phase individually, or a mixture of the first and second phases along with a third phase of intermediate density between the densities of the first and second phases. Any number of phases may be provided in the container and selective dispensing of at least two of the phases independently or a mixture of all of the phases at once can be provided. Selected phases to be dispensed independently may be accomplished by providing a dip tube of a predetermined length, or by varying the amounts of each phase disposed in the container interior. Those having ordinary skill in the art would understand how to achieve various desired combinations of independent phase dispensing from the container.

A further aspect of the invention includes a process for dispensing a composition formed from at least two phases which are substantially mutually immiscible and have differing densities. In one preferred practice of the method, the dispensing uses a container with a variable volume interior and a pump on the container. The process preferably includes selectively arranging the container in a position so as to separate the phases through the effect of their density differences. Thus, one of the phases will be in flow communication with an inlet passage of the pump such that actuating the pump dispenses essentially only that phase of the composition.

The process further includes agitating the contents of the container or the container itself so as to produce a temporary mixture of the two phases. Actuating the pump after such agitation dispenses a mixture formed partly from each of the phases of the composition, the ratio of the concentrations of the phases depending particularly on the degree and time period of agitation.

Preferably, in the case of a composition comprising a first liquid phase and a second liquid phase, the second liquid phase represents approximately 2% to approximately 50% by volume of the total volume of the composition and more preferably approximately 5% to approximately 30% of the total volume of the composition.

The process for dispensing may also include selectively arranging the container in a second position different than that of the first to again separate the phases through the effect of their density differences. Thus, the other of the phases will be in flow communication with the inlet passage of the pump, such that actuating the pump dispenses essentially only that phase of the composition.

Therefore, using the above-described process, it is possible to selectively dispense, either essentially the first phase or essentially the second phase one at a time, or a mixture of the two phases at the same time. This process is particularly suited to the dispensing of two liquid phases.

BRIEF DESCRIPTION OF THE DRAWINGS

Aside from the arrangements set forth hereinabove, the invention includes a number of other arrangements which will be explained hereinbelow, by way of non-limiting exemplary embodiments which are described with reference to the appended drawings, which are incorporated in and constitute a part of this specification. In the drawings.

DETAILED DESCRIPTION OF THE DRAWINGS

Figure 2A:
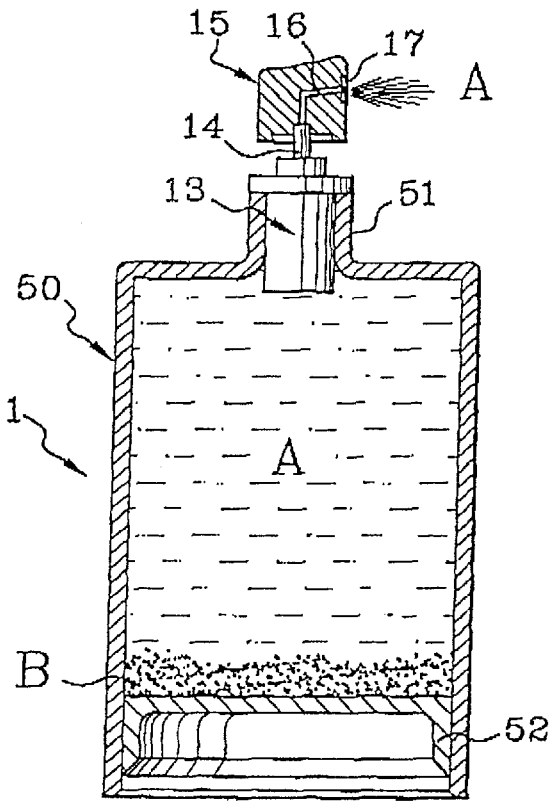
FIGS. 2A–2B are a vertical cross-sectional view of a dispenser according to another embodiment of the present invention.
Figure 2B:
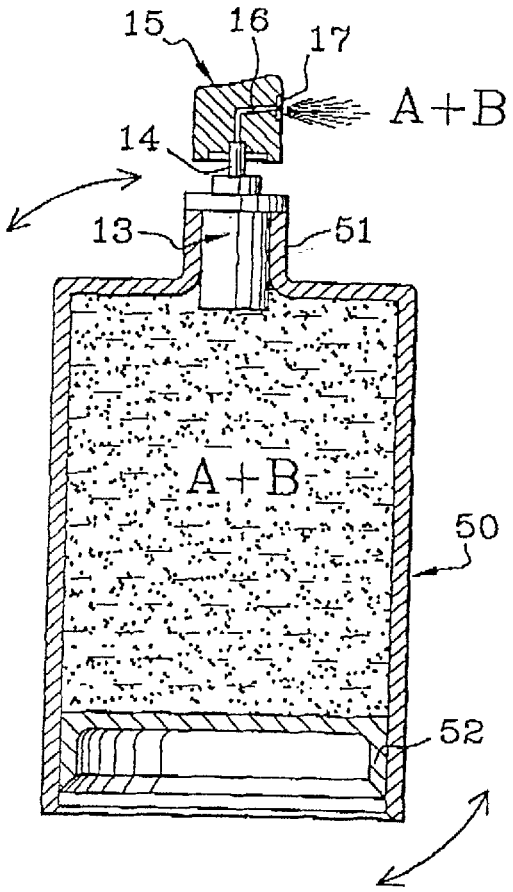

In the embodiment of the invention shown in FIGS. 2A–2B, dispenser 10 comprises a bottle 50 made from thermoplastic material. Bottle 50 has a substantially cylindrical shape and includes a neck 51 disposed at a top portion. An airless pump 13 is force-fitted onto neck 51. Pump 13 includes a pushbutton 15, which includes a diffusion mechanism in the form of a swirling nozzle 17. The bottom of the bottle 50 is open. As the product is dispensed, a piston 52 rises inside bottle 50 through the effect of the reduced pressure resulting from the decreased product volume and the lack of compensation by a corresponding volume of air or other substance. Piston 52 preferably fits inside bottle 50 in a leaktight manner while maintaining its freedom to slide. Alternatively, the bottom of bottle 50 may be closed off by an attached bottom comprising an air-intake orifice.

Intermediate component 5 includes an axial shaft 12 opposite skirts 6 and 8. An airless pump 13 is force-fitted into axial shaft 12. Pump 13 includes an emerging rod 14 on which a pushbutton 15 is fitted. Pushbutton 15 includes a channel 16 connecting emerging rod 14 to a swirling nozzle 17. Swirling nozzle 17 causes diffusion of the composition during dispensing. Other suitable diffusion mechanisms may be used in lieu of or in addition to swirling nozzle 17.

Opposite axial shaft 12, intermediate component 5 has a plurality of regularly spaced small bars 18 extending inside the pouch 2. These small bars essentially form an "anti-blockage" structure capable of preventing the blocking of an inlet passage 19 of pump 13 by the flexible walls of pouch 2 during their collapse as the contents of pouch 2 are dispensed. Inside pouch 2, there preferably is a ball 20 configured to facilitate agitation and mixing of the composition contained in the interior of flexible pouch 2.

In one preferred embodiment of the invention, the composition contained in pouch 2 may comprise a principal phase A that includes a perfume in an aqueous-alcoholic phase with a relatively low water content (e.g., less than approximately 15%) and a secondary phase B formed from a silicon oil containing, for example, a soothing agent such as allantoin and a sun filter. Preferably, secondary phase B constitutes approximately 20% by volume of the total composition and is heavier than aqueous-alcoholic phase A.

Figure 1A:
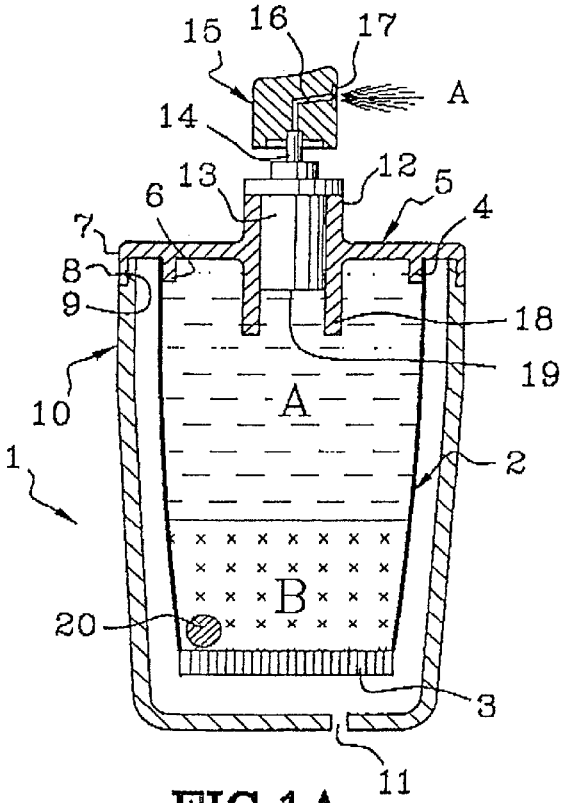
FIGS. 1A–1C are a vertical cross-sectional views of a dispenser according to an embodiment of the present invention.

When dispenser 1 is upright, as shown in FIG. 1A, phase A, the perfume in this example, is at the top and phase B, the silicon oil in this example, is at the bottom. In the position shown in FIG. 1A, pressing on pushbutton 15 sprays perfume in a desired direction via nozzle 17.

Figure 1B:
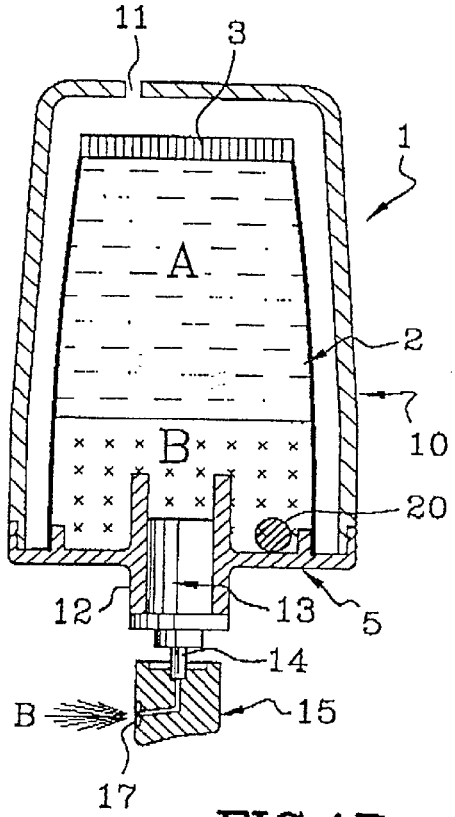

By inverting dispenser 1 into the position shown in FIG. 1B, phase B is placed in communication with the pump 13 and may be sprayed on the desired location by again depressing pushbutton 15. Thus, a slightly oily composition that is capable of soothing the "burn" of the alcohol contained in the perfume and also of protecting the skin against UV radiation, is deposited on the skin. Preferably, phase B will be applied in the location which was previously sprayed with perfume. The skin may be massaged lightly so as to spread the product applied and to promote its penetration.

Figure 1C:
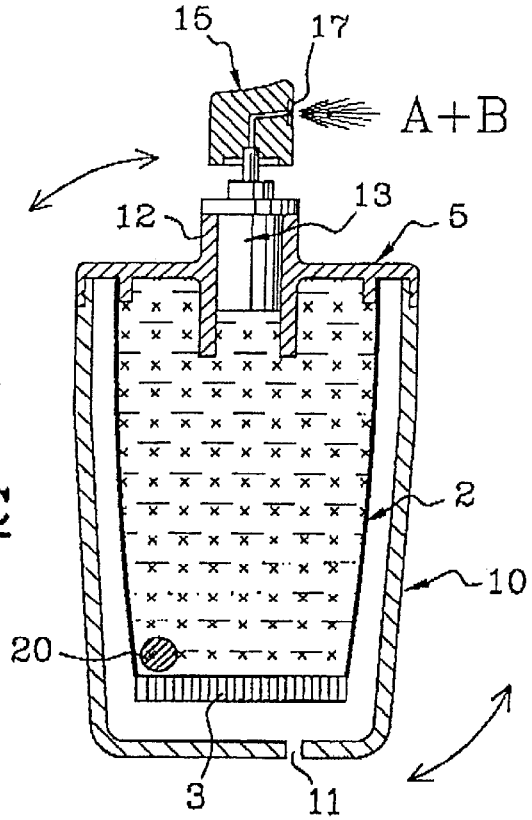

By agitating the assembly in the manner shown in FIG. 1C, the two phases are mixed substantially homogeneously. It is then possible to spray, in the upright or upside-down position, a mixture of the phases A and B which, in this case, has combined fragrancing, soothing and sun-protection properties. By allowing the assembly to stand, the two phases "demix" and eventually resume their respective separated positions within dispenser 1, as shown in FIG. 1A.

In the embodiment of the invention shown in FIGS. 2A–2B, dispenser 10 comprises a bottle 50 made from thermoplastic material. Bottle 50 has a substantially cylindrical shape and includes a neck 51 disposed at a top portion. An airless pump 13 is force-fitted onto neck 51. Pump 13 includes a pushbutton 15, which includes a diffusion mechanism in the form of a swirling nozzle 17. The bottom of the bottle 50 is open. As the product is dispensed, a piston 52 rises inside bottle 50 through the effect of the reduced pressure resulting from the decreased product volume and the lack of compensation by a corresponding volume of air or other substance. Piston 52 preferably fits inside bottle 50 in a leaktight manner while maintaining its freedom to slide. Alternatively, the bottom of bottle 50 may be closed off by an attached bottom comprising an air-intake orifice.

An example of dispensing a perfume containing microcapsules using the inventive dispenser will now be described with reference to FIGS. 2A and 2B. Five grams of microcapsules B containing a perfume in the form of essential oils is placed inside a 50 ml bottle. Bottle 50 is filled with a perfume or cologne A in aqueous-alcoholic phase. Microcapsules B are denser than the aqueous perfume and, in the position of bottle 50 shown in FIG. 2A, are deposited at the bottom of bottle 50. In this position, by pressing the pushbutton, dispenser 100 sprays essentially aqueous perfume in a direction via nozzle 17. In particular, depending on the relative phase densities and time allowed for phase separation after an agitation of the bottle, at least approximately 85% of aqueous perfume will exit nozzle 17.

When the user wishes to modify the scent of the perfume or to strengthen it, bottle 50 is agitated. Upon agitation, microcapsules B will be placed in suspension with aqueous perfume A, as shown in FIG. 2B. The number of such suspended microcapsules B depends on the period and degree of agitation of bottle 50. By actuating pushbutton 150, some of the microcapsules B will be aspirated by pump 130 and sprayed together with the aqueous perfume A. Microcapsules B may be "crushed" when passing through the pump, which will give rise to the release of the essential oils contained therein. Alternatively, the essential oils will be released after application of the mixture to the skin by lightly massaging the microcapsules B into the skin. If the dispenser is allowed to stand without agitation, microcapsules B will eventually resume their position at the bottom of the container, as shown in FIG. 2A.

It will be understood that this disclosure, in many respects, is only illustrative. Changes may be made in details, particularly in matters of shape, size, material, number and arrangement of parts without exceeding the scope of the invention. Accordingly, the scope of the invention is as defined in the language of the appended claims.

For example, the dispenser and process for its use may be used for dispensing compositions of phases that are immiscible and have differing densities other than cosmetic product compositions. Furthermore, while the embodiments discussed use a pump to dispense the composition from the container, other dispensing mechanisms, such as a valve with an aerosol assembly, also are within the scope of the invention. Regardless of the dispensing mechanism selected, the container interior volume preferably decreases when the composition is dispensed from the container.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A dispenser comprising:

a container including an interior with a variable volume;

a composition in the interior of the container, the composition including at least two substantially immiscible phases having differing densities, the differing densities allowing the phases to separate from each other within the container, and an airless pump in flow communication with the interior of the container to pump at least one of the phases of the composition individually from the container.

2. The dispenser of claim 1, wherein the container includes at least one deformable portion that deforms as at least one of the phases is pumped from the container.

3. The dispenser of claim 2, wherein the container is a pouch having flexible walls.

4. The dispenser of claim 3, further comprising a rigid enclosure, the pouch being inside the rigid enclosure.

5. The dispenser of claim 2, further comprising a flow enabling member configured to prevent closing off of a flow path leading to the pump when said deformable portion deforms.

6. The dispenser of claim 1, wherein the container comprises one of a flexible tube, a bottle with at least one wall forming bellows, a bottle with at least one thin wall, and a membrane.

7. The dispenser of claim 6, wherein the membrane is an elastic membrane.

8. The dispenser of claim 1, wherein the pump is provided on the container.

9. The dispenser of claim 8, wherein the pump is connected to the container by one of crimping, screwing, and force-fitting.

10. The dispenser of claim 1, further comprising an intermediate connecting piece provided on the container, the pump being connected to the intermediate connecting piece.

11. The dispenser of claim 1, further comprising a tube placing the pump in flow communication with the interior of the container.

12. The dispenser of claim 1, wherein the pump includes an actuator.

13. The dispenser of claim 12, wherein the actuator is a pushbutton mechanism.

14. The dispenser of claim 1, wherein the pump includes a diffusion member through which said at least one phase exits upon dispensing.

15. The dispenser of claim 14, wherein the diffusion member includes a nozzle.

16. The dispenser of claim 1, wherein the composition includes a liquid phase and a particulate phase having a density different from that of the liquid phase.

17. The dispenser of claim 16, wherein the volume of the particulate phase ranges from approximately 0.5% to approximately 30% by volume of the total volume of the composition.

18. The dispenser of claim 16, wherein the volume of the particulate phase ranges from approximately 1% to approximately 10% of the total volume of the composition.

19. The dispenser of claim 16, wherein the particulate phase is in the form of one of powder, microcapsules, nanocapsules, pigments, fillers and pearlizers.

20. The dispenser of claim 1, wherein the composition comprises two immiscible liquid phases having differing densities.

21. The apparatus of claim 1, further comprising an agitation mechanism disposed within the interior of the container to facilitate agitation of the composition.

22. The dispenser of claim 1, wherein the pump is a precompression type pump.

23. The dispenser of claim 1, wherein at least one of the phases is a liquid.

24. The dispenser of claim 1, wherein at least one of the phases is a cosmetic product.

25. A dispenser comprising:

a container including a variable-volume interior;

a composition in the interior of the container including at least first and second substantially immiscible phases having differing densities, the differing densities allowing the phases to separate from each other within the container; and a dispensing member in flow communication with the interior of the container, wherein the dispenser is configured to allow selection of any one of the following dispensing modes:

each phase individually; and a mixture of at least two of said phases.

26. A dispenser comprising:

a container including a variable-volume interior;

a composition in the interior of the container including at least first and second substantially immiscible phases having differing densities, the differing densities allow the phases to separate from each other within the container; and a dispensing member in flow communication with the interior of the container, wherein the dispenser is configured to allow dispensing of each phase individually.

27. The dispenser of claim 25, wherein the dispensing member includes a pump permitting flow therethrough in one direction only.

28. The dispenser of claim 27, wherein the pump is mounted on the container.

29. The dispenser of claim 28, wherein the pump includes a tube providing flow communication between the pump and the interior of the container.

30. The dispenser of claim 25, wherein the composition entirely fills the interior of the container.

31. The dispenser of claim 25, wherein the first phase of the composition is a liquid phase and the second phase of the composition is a particulate phases.

32. The dispenser of claim 25, wherein the first and second phases of the composition are liquid phases.

33. The dispenser of claim 25, wherein the container includes a housing and a piston movable in the housing, the housing and piston defining the interior of the container.

34. The dispenser of claim 25, wherein the container includes at least one deformable portion.

35. The dispenser of claim 34, wherein the container includes deformable sidewalls configured to collapse toward each other during dispensing from the dispenser.

36. The dispenser of claim 25, wherein the container is configured such that volume of the container decreases corresponding to dispensing from the dispenser.

37. The dispenser of claim 36, wherein the container includes a housing and a piston movable in the housing, the housing and the piston defining the interior of the container.

38. The dispenser of claim 25, wherein at least one of the phases is a cosmetic product.

39. A method of dispensing, the method comprising:

providing a dispenser including a container having a variable-volume interior, a dispensing member in flow communication with the interior, and a composition in the interior, the composition including at least two substantially immiscible phases having differing densities, the differing densities allowing the phases to separate from each other within the container;

selectively arranging the container; and actuating the dispensing member to selectively dispense each phase individually depending on the selective arranging of the container.

40. The method of claim 39, further comprising permitting the phases to substantially separate prior to actuating the dispensing member.

41. The method of claim 39, wherein the selective arranging of the container includes arranging the container in one of a first position and a second position and allowing the phases to substantially separate.

42. The method of claim 41, wherein, in the first position, the dispensing member is in flow communication with a first of the phases after the phases separate and, in the second position, the dispensing member is in flow communication with a second of the phases after the phases separate.

43. The method of claim 39, further comprising agitating the composition to temporarily mix the phases together, and actuating the dispensing member to dispense the mixture of the phases.

44. The method of claim 43, further comprising controlling the relative concentrations of the phases in the mixture by regulating the agitation of the composition.

45. A method of dispensing, the method comprising:

providing a dispenser including a container having a variable-volume interior, an airless pump on the container, and a composition in the interior of the container, the composition including at least two substantially immiscible phases having differing densities, the differing densities allowing the phases to separate from each other within the container;

selecting the dispensing of either one of the phases of the composition individually or a mixture of at least two of the phases at the same time by either a) arranging the container in a position so that, after separation of the phases by their differences in density, one of the phases is in flow communication with the pump, and then actuating the pump so as to dispense individually said one phase; or b) agitating the contents of the container so as to produce a temporary mixture of the two phases and then actuating the pump so as to dispense a mixture of at least two of the phases, the ratio of concentrations of the phases depending on the degree of agitation.

46. The method of claim 45, wherein there are two substantially immiscible phases.

47. The method of claim 46, wherein one of the phases is a first liquid phase, and the other of the phases is a second liquid phase, the first liquid phase being immiscible with the second liquid phase and having a density differing from that of the second liquid phase.

48. The method of claim 47, wherein the volume of the second liquid phase ranges from approximately 2% to approximately 50% of the total volume of the composition.

49. The method of claim 47, wherein the volume of the second liquid phase ranges from approximately 5% to approximately 30% of the total volume of the composition.

50. The method of claim 46, wherein one of the phases is a liquid phase and the other of the phases is a particulate phase, the particulate phase having a density differing from that of the liquid phase and being immiscible with the said liquid phase.

51. The method of claim 50, wherein the volume of the particulate phase ranges from approximately 0.5% to approximately 30% of the total volume of the composition.

52. The method of claim 50, wherein the volume of the particulate phase ranges from approximately 1% to approximately 10% of the total volume of the composition.

53. The method of claim 50, wherein the particulate phase is formed from one of fillers, pigments, pearlizers, microcapsules, nanocapsules and talc.

54. The method of claim 45, further comprising:

selectively dispensing another of the phases individually by c) arranging the container in a second position so that, after separation of the phases by their differences in density, said another of the phases is in flow communication with the pump, and then actuating the pump so as to dispense said another phase individually.

55. A method for dispensing, the method comprising:

providing a dispenser including a container having a variable-volume interior, and a composition in the interior, the composition including at least two substantially immiscible phases having differing densities, the differing densities allowing the phases to separate within the container;

selectively arranging the container; and selectively dispensing either one of the phases of the composition individually or a mixture of at least two of the phases at the same time.

* * * * *

UNITED STATES PATENT AND TRADEMARK OFFICE

CERTIFICATE OF CORRECTION

PATENT NO. : 6,352,182 B1
DATED : March 5, 2002
INVENTOR(S) : Jean-Louis H. Gueret It is certified that error appears in the above-identified patent and that said Letters Patent is hereby corrected as shown below:

Column 9,
Line 36, replace "container, and" with -- container; and --.

Signed and Sealed this

Twenty-first Day of May, 2002

*Attest:*

*Attesting Officer*

JAMES E. ROGAN
*Director of the United States Patent and Trademark Office*